United States Patent [19]

Vanderminden

[11] Patent Number: 4,971,394

[45] Date of Patent: Nov. 20, 1990

[54] SWIVEL ROCKER CHAIR

[75] Inventor: Robert D. Vanderminden, Grandville, N.Y.

[73] Assignee: Telescope Casual Furniture Company, Granville, N.Y.

[21] Appl. No.: 850,224

[22] Filed: Apr. 10, 1986

Related U.S. Application Data

[63] Continuation of Ser. No. 653,716, Sep. 24, 1984, abandoned.

[51] Int. Cl.[5] ..... A47C 1/02

[52] U.S. Cl. ..... 297/349; 297/290; 297/286

[58] Field of Search ..... 297/349, 290, 300, 286, 297/301, 294; 248/415; 108/139

[56] References Cited

U.S. PATENT DOCUMENTS

| | | | |
|---|---|---|---|
| 2,859,801 | 11/1958 | Moore | 297/822 |
| 3,773,383 | 11/1973 | Ekornes | 297/320 |
| 3,934,932 | 1/1976 | Ekornes | 297/320 |
| 3,947,069 | 3/1976 | Lusch | 297/342 |
| 4,361,357 | 11/1982 | Pollock | 297/349 X |

*Primary Examiner*—Laurie K. Cranmer

*Attorney, Agent, or Firm*—Kenyon & Kenyon

[57] ABSTRACT

The swivel rocker is made of tubular construction, particularly for outdoor use. The seat frame is pivotally mounted about a vertical axis on a stationary base and includes a seat which is secured to a support by arm rests which are able to flex and thus impart a rocking action between the seat and support. The arm rests are curved with ends which are connected to rods which are rotatably mounted in guide tubes of the support.

27 Claims, 3 Drawing Sheets

Fig. 6.
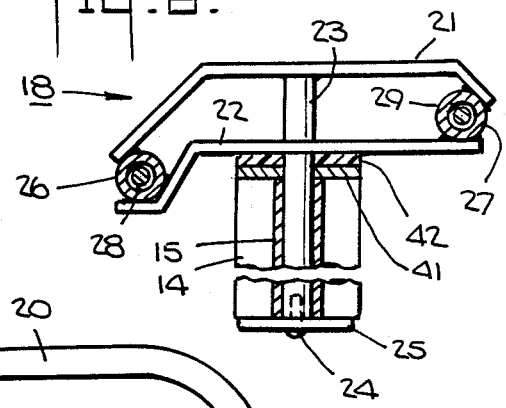
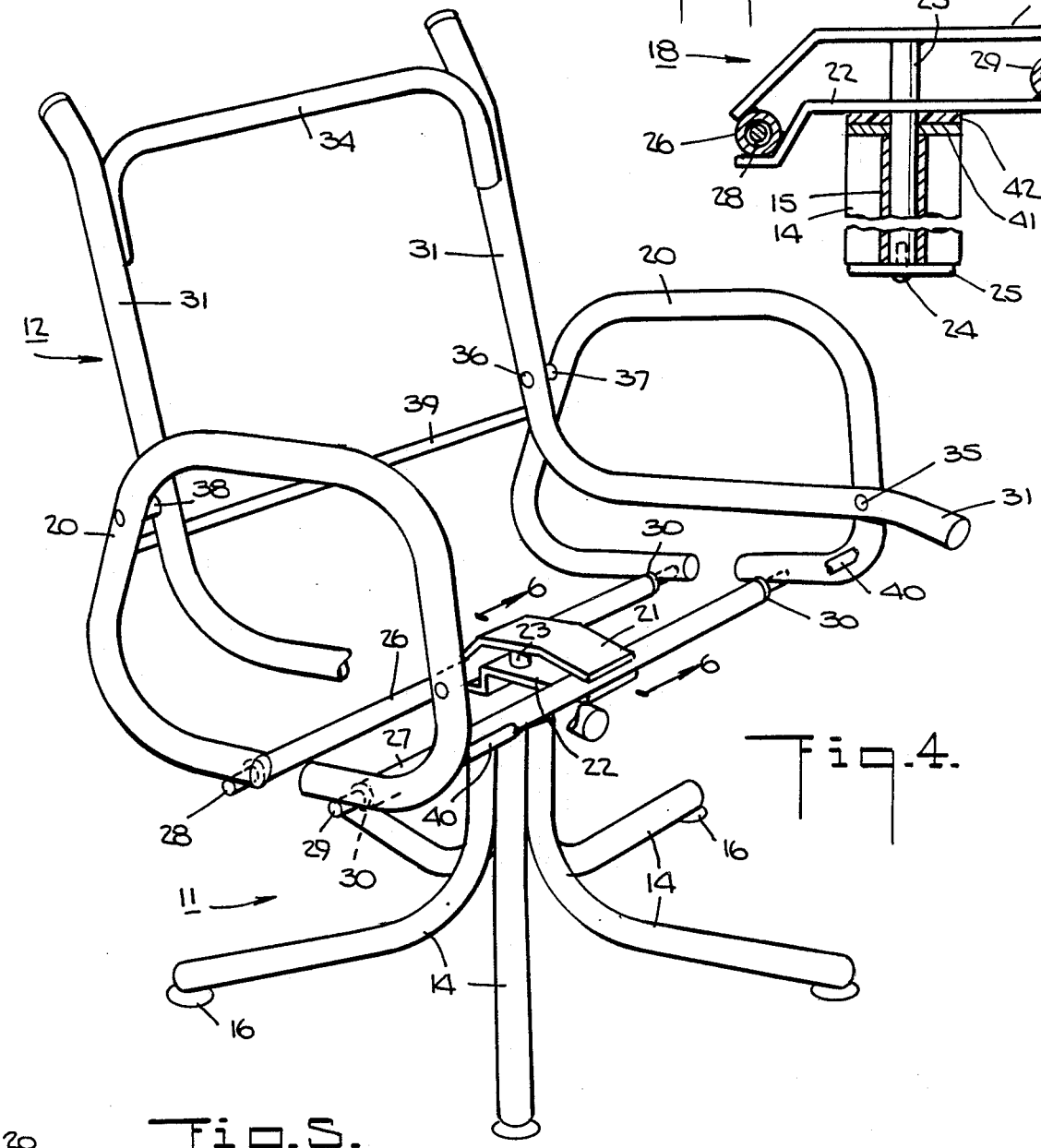
Fig. 4.
Fig. 5.
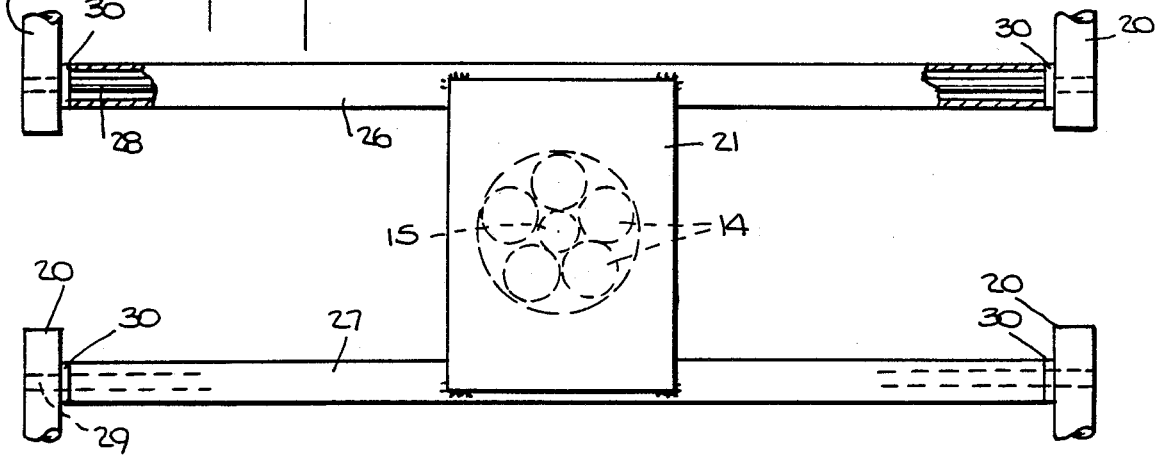

SWIVEL ROCKER CHAIR

This is a continuation of application Ser. No. 653,716 filed Sept. 24, 1984, now abandoned.

This invention relates to a swivel rocker chair. More particularly, this invention relates to a swivel rocker chair which can be used outdoors.

Heretofore, various types of chairs have been constructed in order to swivel and to rock. For example, it has been known to construct a chair with a seat which is able to pivot on a frame about a vertical axis passing through the frame and to mount a seat back in a spring-loaded manner so as to pivot back and forth relative to the seat. Such arrangements have been of well known construction and have been particularly used for office seating.

Generally, the known types of swivel rocker chairs have been of relatively heavy weight and of cumbersome construction Further, these chairs have generally been used only in business offices.

Accordingly, it is an object of the invention to provide a swivel rocker chair of light weight construction and mechanical simplicity.

It is another object of the invention to provide a swivel rocker chair which can be used outdoors.

It is another object of the invention to construct a chair of outdoor furniture type which is capable of pivoting and rocking in a stable manner.

It is another object of the invention to fabricate a swivel rocker chair in a relatively easy manner It is another object of the invention to be able to easily replace the seat and back fabric of a swivel rocker.

Briefly, the invention provides a swivel rocker chair which comprises a base and a seat frame which is pivotally mounted on the base. In addition, the seat frame includes a support for mounting on the base, a seat which is disposed above the support and means securing the seat to the support for rocking of the seat back and forth relative to the support.

The base is constructed to have a central post for example with a plurality of outwardly directed legs extending from the post so as to support the chair in a stationary manner. In addition, the base has a guide means, such as a tube, within the legs which is disposed on a vertical axis about which the seat frame is to pivot, i.e. swivel.

The support of the seat frame includes a housing from which a depending stem extends into the guide means of the post to permit swiveling of the seat frame about the vertical axis of the post. In addition, the support has a pair of horizontally spaced parallel tubes fixed to and extending from the housing as well as a pair of rods, each of which is rotatably mounted in and which extends from opposite ends of a respective tube.

The seat is of any suitable construction, for example being made of a tubular frame with a web of material defining a seat portion and a back portion.

The means securing the seat to the support includes a pair of arms rests which are secured at opposites sides to the seat. Each arm rest is mounted on the support to permit flexing of the arm rests during rocking of the seat relative to the support. To this end, each arm rest has a pair of ends, each of which is secured to an end of a rod of the support in spaced relation to the other end of the arm rest. Further, each arm rest is of tubular cross-section, for example being of circular or rectangular cross-section.

In use, the chair is able to swivel via the depending stem of the seat frame support and the guide tube of the base. In addition, the seat can be rocked back and forth by an occupant relative to the support of the seat frame by means of the arm rests. In this regard, each arm rest acts as a flexure member to permit the rocking action of the seat. During rocking, each rod which is rotatably mounted in and across the seat support rotates with the end of the arm rest to which the rod is attached so as to enhance the flexing action of the arm rests.

The rods on which the arm rests are mounted are horizontally spaced apart to aid in the flexing of the arm rests. In addition, the rods are vertically spaced relative to each other to impart a slight rearward tilt to the seat relative to the support and the base.

These and other objects and advantages of the invention will become more apparent from the following detailed description taken in conjunction with the accompanying drawings wherein:

FIG. 4 illustrates a partial broken away view of the chair of FIG. 1;

FIG. 5 illustrates a plan view of the seat support constructed in accordance with the invention; and FIG. 6 illustrates a view taken on line 6—6 of FIG. 4.

Figure 1:
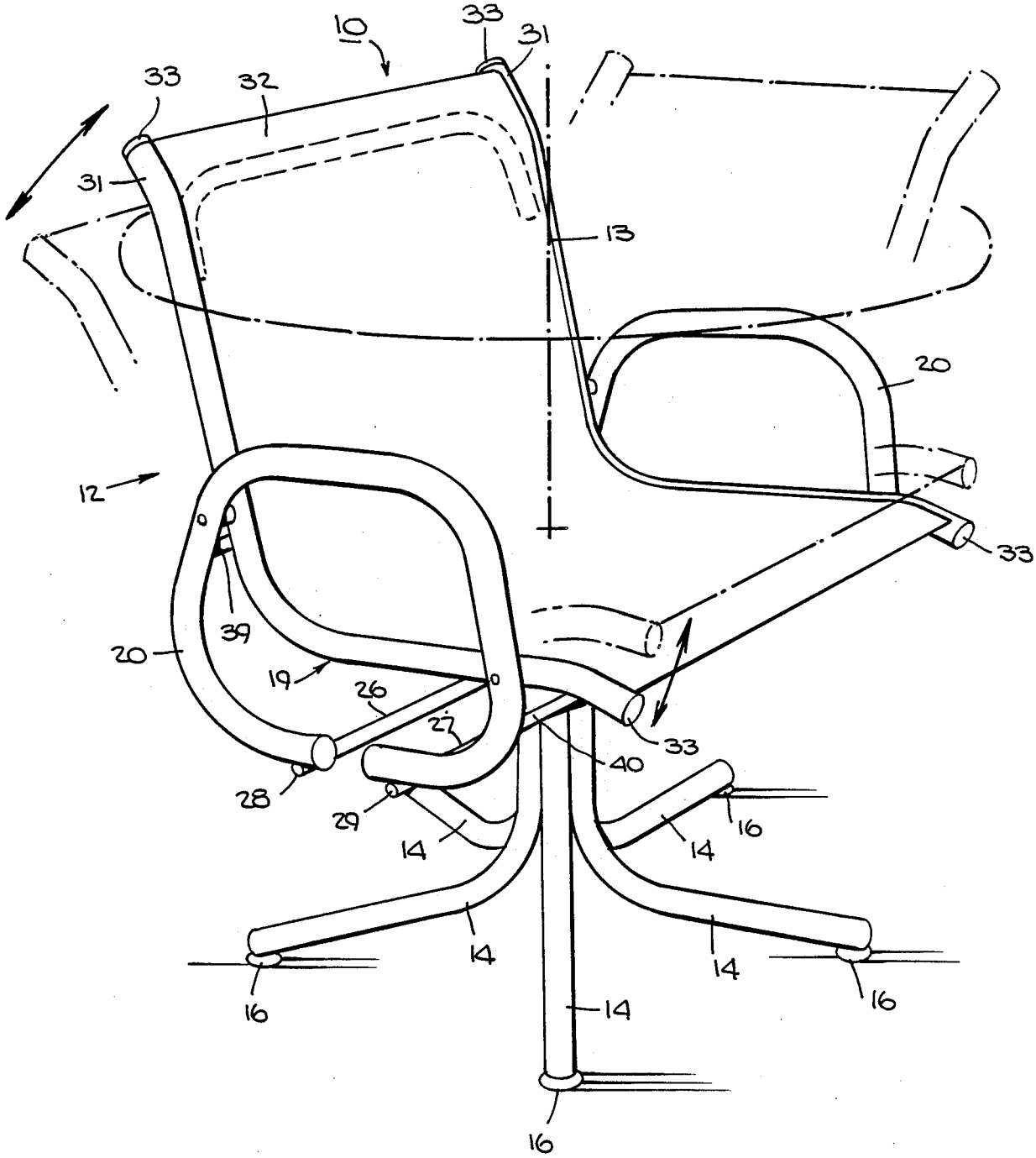
FIG. 1 illustrates a perspective view of a swivel rocker chair constructed in accordance with the invention.

Referring to FIG. 1, the swivel rocker chair 10 is constructed of a base 11 and a seat frame 12. In this regard the seat frame 12 is pivotally mounted on the base 11 in order to rotate, i.e. swivel, about a vertical axis 13 while also being internally constructed to have a rocking motion.

Figure 2:
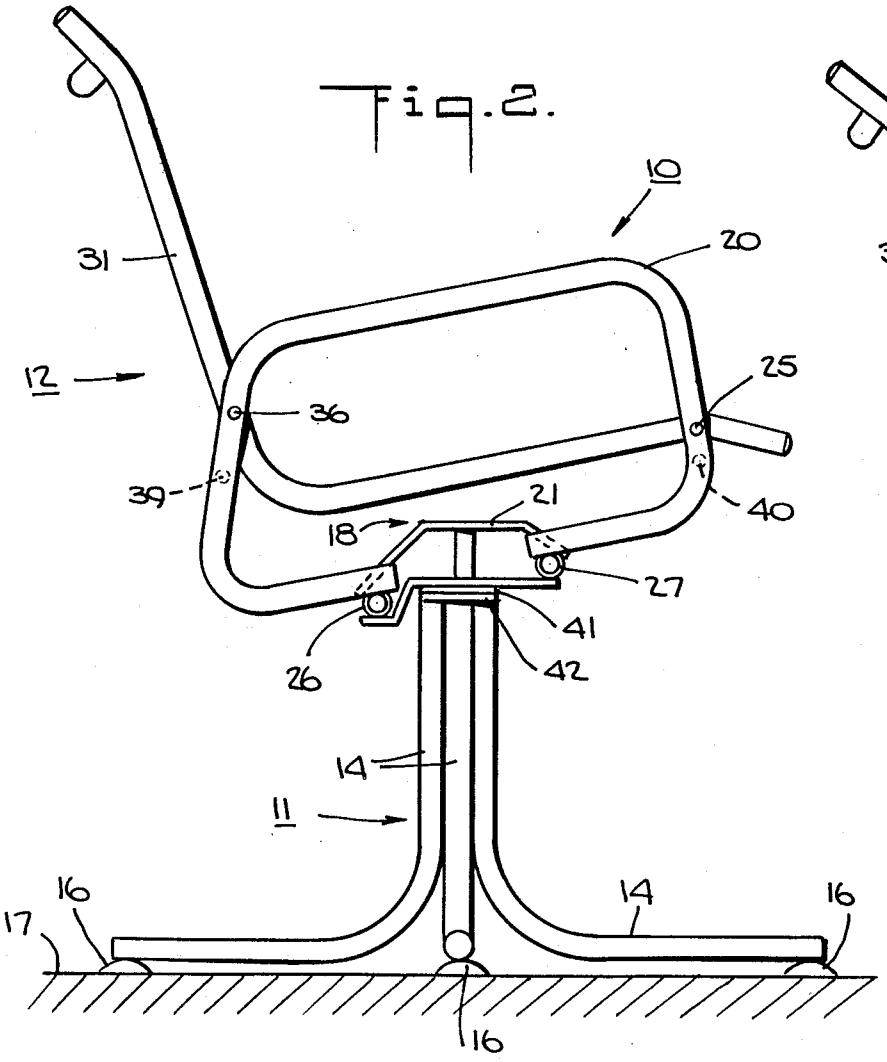
FIG. 2 illustrates a side view of the chair of FIG. 1.

Referring to FIGS. 1 and 2, the base 11 includes a plurality of, L-shaped legs 14, e.g. five, which are circumferentially disposed about the vertical axis 13 and a guide means in the form of an elongated tube 15 (see FIG. 5) which is disposed within the legs 14 on the vertical axis 13. Each L-shaped leg 14 is of metal with a tubular construction, for example, of cylindrical cross-section, and is formed with a vertical portion parallel to the vertical axis 13 and an outwardly directed portion which extends substantially horizontally away from the axis 13. The vertical portions of the legs 14 and the guide tube 15 define a central post for supporting the seat frame 12. As indicated, each leg 14 carries a foot 16 at the outer end for supporting the base 11 on a suitable support surface or floor 17. Each foot 16 may be made of a suitable plastic for supporting the chair 10 in a stationary manner on the support surface 17.

Referring to FIGS. 1 and 4, the seat frame 12 includes a support 18 which is mounted on the central post of the base 11, a unitary seat 19 which is disposed above the support 18 and means in the form of arm rests 20 for securing the seat 19 to the support 18 for rocking of the seat 19 back and forth relative to the support 18.

Referring to FIGS. 4, 5 and 6, the support 18 includes a housing which is formed of two flat metal plates 21, 22 which are disposed in vertically spaced apart relation. As indicated in FIG. 4, the plates 21, 22 are of a width of about 5½ inches while being spaced apart by about 1½ inches. In addition, the support 18 has a vertical metal stem 23 fixed to and extending from the housing formed by the plates 21, 22 into the guide tube 15 of the post of the base 11. As indicated in FIG. 6, the stem 23 is secured to the plates 21, 22 as by welding and is of solid construction. Further, the stem 23 is sized of a diameter to be telescopically received within the guide tube 15 in a rotatable manner coaxial of the vertical axis 13 of the base 11. Still further, the stem 23 is drilled and tapped at the lower end to receive a bolt 24 A washer 25 is also disposed about the bolt 24 and is held by a head of the bolt 24 against the lower end of the guide tube 15 so that the stem 23 is fixed to the guide tube 15 to prevent axial separation of the stem 23 from the guide tube 15 and, thus, the seat frame 12 from the base 11. At the same time, the washer 25 permits rotation of the stem 23 relative to the guide tube 15.

The support 18 also has a pair of horizontally spaced parallel tubes 26, 27 which are fixed to and extend from between the plates 21,22. In this respect, as indicated in FIG. 6, the tubes 26,27 are fixed to the front and rear edges of the plates 21, 22 as by welding and extend over a substantial width of the seat frame 12. These tubes 26,27 may also be provided with inserts, such as ¾ inch diameter 16 gauge steel tube inserts, for additional support. Further, the plates 21,22 are shaped and the tubes 26,27 are positioned so that the tubes 26,27 are located in horizontal planes which are vertically spaced relative to each other.

Still further, the support 18 includes a pair of metal rods 28,29 each of which is rotatably mounted in and which extends from opposite ends of a respective tube 26,27. As indicated in FIG. 5, each tube 26,27 has an annular bearing ring 30 fixed in each end and in which a respective rod 28,29 is rotatably mounted.

Referring to FIGS. 1 and 4, the seat 19 is constructed of a pair of L-shaped tubular members 31 which support a web 32 of fabric therebetween to define a seat portion and a back portion. Alternatively, any other type of seating material may be used. Where a web 32 is used, the members 31 can be provided with longitudinally disposed slots (not shown) into which edges of the web 32 may be slid and held in place. In this regard, suitable end caps 33 are provided at the ends of the tubular members 31 to retain the web 32 in place.

The seat 19 is also provided with a generally U-shaped reinforcing rod 34 at an upper end of the seat 19.

Referring to FIG. 4, the arm rests 20 for securing the seat 19 to the support 18 are secured to opposite sides of the seat 19. Each arm rest 20 is of curved shape and has a pair of horizontally spaced ends which are fixed to the respective rods 28,29. Each arm rest 20 is also secured at two points as by bolts 35,36 to the seat 19, for example, at a forward end of the seat portion and at a lower end of the back portion. In this respect, the bolts 35,36 may be passed through the hollow member 31 of the seat into threaded studs (not shown) secured to the arm rests 20 with suitable spacers 37,38 about the bolts 35,36 between the seat 19 and arm rests 20.

As indicated in FIG. 4, a pair of reinforcing rods 39,40 extend between the arm rests 20; one near the front of the chair and one at the rear of the chair.

Figure 3:
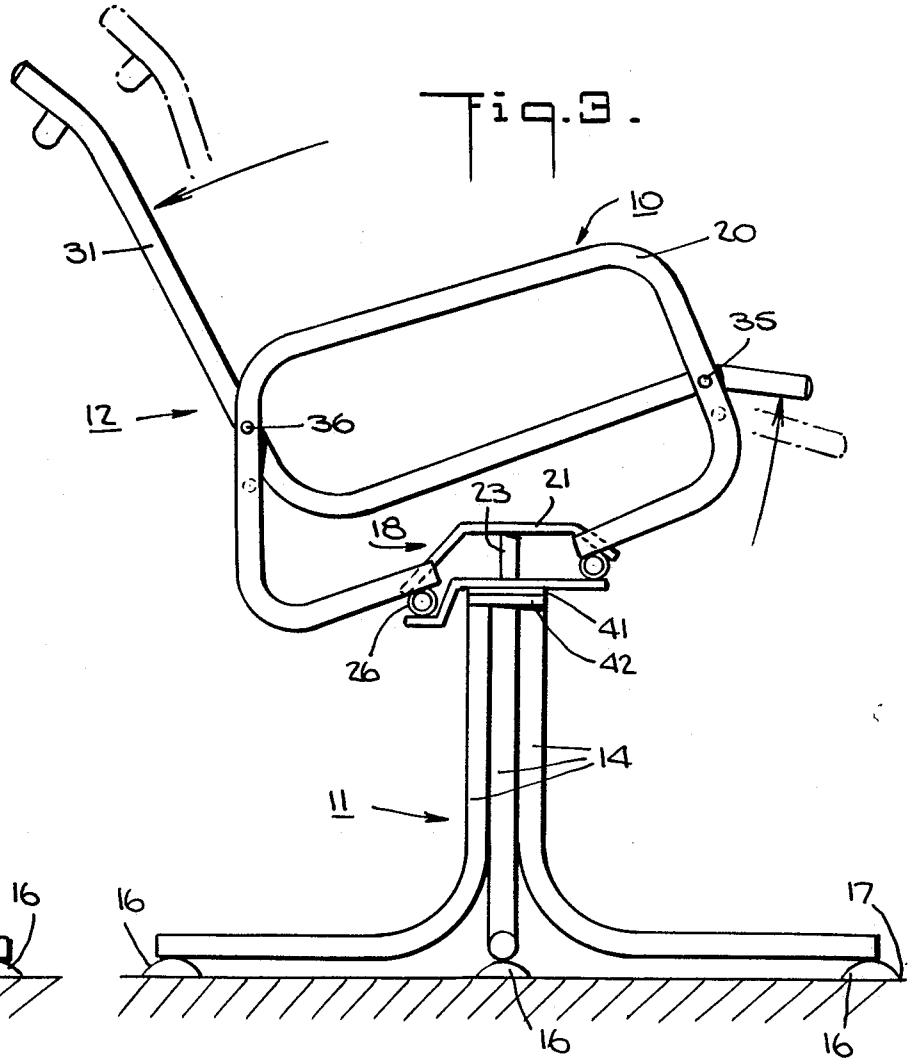
FIG. 3 illustrates a side view of the chair during rocking.

Each arm rest 20 is of hollow metal cross-section and is shaped and mounted on the support 18 to permit flexing of the ends of the arm rests 20 relative to each other. For example, as shown in FIG. 2, without any occupant in the chair 10, the seat frame 12 is in an upright manner with the seat 19 tilted slightly to the rear. In this condition, the seat portion of the seat 19 forms a slight angle to a horizontal plane. To this end, the tubes 26,27 of the support 18 are disposed in different vertical planes. At this time, the inwardly turned ends of each arm rest 20 are disposed on a substantially common axis. However, as indicated in FIG. 3, when the seat 19 is rocked backwardly, for example by an occupant, the two ends of each arm rest 20 rotate with the rods 28,29 so that the ends are displaced angularly with respect to this common axis. Further, the remainder of the arm rests 20 take up the flexing action. A forward motion of the seat 19 causes a similar flexing of the arm rests 20 but in an opposite sense. The arm rests 20 thus serve multiple functions in not only mounting the seat 19 on the support 18, but also in acting as springs to permit rocking of the seat 19.

Referring to FIG. 6, the chair 10 may be provided with suitable bearing pads 41,42 between the base 11 and seat 12 to transfer the loadings of the seat frame 12 onto the base 11. For example, a metal bearing pad 41 of 3½ inch diameter may be rotatably mounted on top of the central post of the base 11 about the stem 23 to spread the loading of the seat frame 12 over a substantial area of the post while a plastic bearing pad 42 e.g. of self-lubricating type is disposed between the metal bearing pad 41 and the lower housing plate 22 of the support 18 to facilitate a rotational movement between the seat frame 12 and base 11.

When in use the weight of an occupant is transferred from the seat 19 through the arm rests 20 directly onto the ends of the rods 28,29 of the support 18. The weight is then transferred via the tubes 26,27 housing plates 21,22 and bearing pads 41,42 to the post of the base 11.

In order to assemble the chair 10, the base 11 is fabricated with the legs 14 and guide tube 15 secured to each other, as by welding while the seat frame is fabricated at a separate location. In this respect, the housing 18 and arm rests 20 may be fabricated independently of the seat 19 since the seat 19 can be subsequently secured to the arm rests 20 by the bolts 35,36.

The seat frame 12 may then be mounted on the base 11 by sliding the stem 23 into the guide tube 15. Thereafter, the bolt 24 is put in place to fix the seat frame 12 to the base 11 for rotation about the vertical axis.

The arm rests 20 may be secured to the rods 28,29 in any suitable fashion. For example, the arm rests 20 may be welded to the ends of the rods 28,29 which project from the tubes 26,27 or may be secured as by bolts which pass through the rods 28,29 into threaded studs or the like on or within the hollow arm rests.

Of note, various modifications may also be made in the construction of the chair. For example, the base 11 may be of pedestal type, for example with a circular cross-sectional shape. The base 11 may also be of solid construction for example being made of cast aluminum or other metal, or plastic. Likewise, rather than using a tube 15, the guide means for the stem 23 of the seat frame 12 may be in the form of a pair of vertically spaced plastic sleeves secured between and to the legs 14.

Further, the seat 19 may be of any suitable construction for example instead of using a web, a strip of mesh material may be used. Also, straps, webbing, tubing, woven fabric, or any other suitable fabric or material can be used with or without cushions to define a seat portion and a back portion. Depending on the type of seat, the tubular members 31 may be modified to accommodate the seating materials.

The invention thus provides a swivel rocker chair which can be constructed in a relatively simple manner.

Further, the invention provides a swivel rocker chair which is aesthetically pleasing and which can be readily adapted for outdoor use, for example, for recreational purposes, dining purposes and the like.

Of note, the various members from which the chair are made may be of tubular construction with cylindrical or rectangular cross-sections or of flat construction.

Further, the chair can be made of any suitable metal material.

The chair is made of simple light weight construction which permits a pivoting action of a seat frame relative to a base as well as a rocking action of the seat relative to a support of a seat frame.

What is claimed is:

1. A swivel rocker chair comprising
a base having a central post disposed on a vertical axis;
a support pivotally mounted on said post for rotation about said axis;
a seat; and
means securing said seat to said support for rocking of said seat relative to said support, said means including a pair of arm rests secured to opposite sides of said seat, each of said arm rest having a pair of horizontally spaced ends pivotally mounted on said support to permit flexing of said ends of each arm rest relative to each other.

2. A swivel rocker chair as set forth in claim 1 wherein each arm rest is of curved shape and is of hollow cross section.

3. A swivel rocker chair as set forth in claim 1 wherein said support includes a housing, a pair of horizontally spaced parallel tubes fixed to said housing and a pair of rods, each of said rod being rotatably mounted in and extending from opposite ends of a respective tube and being fixed at opposite ends to a respective arm rest.

4. A swivel rocker chair as set forth in claim 3 wherein each arm rest is of curved shape between said ends thereof to permit flexing of said ends of each arm rest relative to each other.

5. A swivel rocker chair as set forth in claim 3 wherein said rods are vertically spaced relative to each other to impart a backward tilt to said seat relative to said post.

6. A swivel rocker chair as set forth in claim 1 wherein said base includes a plurality of legs disposed about said vertical axis and a guide means within said legs and disposed on said axis, each leg having a vertical portion and an outwardly directed portion, said vertical portions of said legs and said guide means defining said post.

7. A swivel rocker chair as set forth in claim 1 wherein said support includes a stem rotatably mounted in and axially secured to said post on said axis.

8. A swivel rocker chair as set forth in claim 7 which further comprises at least one bearing plate between said support and said post.

9. A swivel rocker chair comprising
a base having a central post with a plurality of outwardly directed legs extending from said post; and
a seat frame pivotally mounted on said base, said seat frame including a support having a housing, a vertical stem fixed to and extending from said housing into said post of said base for relative rotation therein, a pair of horizontally spaced parallel tubes fixed to and extending from said housing and a pair of rods, each said rod rotatably mounted in and extending from opposite ends of a respective tube;
a seat disposed above said support; and a pair of flexible arm rests secured to opposite sides of said seat, each said arm rest having a pair of ends with each end fixed to a respective one of said rods to permit rocking of said seat relative to said support.

10. A swivel rocker chair as set forth in claim 9 which further comprises at least one bearing pad disposed between said housing and said post.

11. A swivel rocker chair as set forth in claim 9 wherein said housing includes a pair of spaced plates and said tubes extend from between and are fixed to said plates.

12. A swivel rocker chair as set forth in claim 9 wherein each arm rest is of curved shaped.

13. A swivel rocker chair as set forth in claim 12 wherein said rods are vertically spaced from each other to impart a tilt to said seat relative to said base.

14. A seat frame for a swivel rocker comprising
a support;
a seat; and
a pair of flexible arm rests secured to opposite sides of said seat, each arm rest having a pair of spaced ends secured to said support for rocking of said seat relative to said support.

15. A seat frame as set forth in claim 14 wherein each arm rest is of curved shape between said ends to permit flexing of said ends of each arm rest relative to each other.

16. A seat frame as set forth in claim 14 wherein said support includes a housing, a pair of horizontally spaced parallel tubes fixed to said housing and a pair of rods, each said rod being rotatably mounted in and extending from opposite ends of a respective tube and being fixed to respective ends of said arm rests.

17. A seat frame as set forth in claim 14 wherein said support includes a pair of parallel spaced apart rotatably mounted rods and each arm rest has a respective end secured to a respective rod for rotation therewith.

18. A seat frame as set forth in claim 14 wherein each end of each arm rest is pivotally mounted on said support.

19. A swivel rocker chair comprising
a base, and
a seat frame including a support pivotally mounted on said base, a seat disposed above said support and a pair of flexible arm rests securing said seat to said support for rocking of said seat back and forth relative to said support, each of said arm rest having a pair of ends with each of said end pivotally mounted on said support in spaced apart relation to the other end of said pair of ends.

20. A swivel rocker chair as set forth in claim 19 wherein said each arm rest is of tubular cross-section.

21. A swivel rocker chair as set forth in claim 19 wherein each arm rest has a flat rectangular cross-section.

22. A swivel rocker chair as set forth in claim 19 wherein said base includes a vertical post with plurality of outwardly directed legs extending from said post.

23. A swivel rocker chair comprising
a base; and
a seat frame pivotally mounted on said base to rotate about a vertical axis, said seat frame including a support pivotally mounted on said base for pivoting about said axis, a seat portion, an upstanding back portion and means for securing at least said seat portion to said support for rocking of said seat portion relative to said support, said means including a pair of arm rests, each arm rest having a depending portion below said seat portion and a first inwardly turned portion secured to said support to permit flexing of said depending portion and the remainder of said arm rest during rocking of said seat portion relative to said support.

24. A swivel rocker as set forth in claim 23 wherein each arm rest has a second inwardly turned portion secured to said support on an opposite side thereof to permit flexing thereof during rocking of said seat portion relative to said support.

25. A swivel rocker as set forth in claim 23 wherein each arm rest is of hollow cross-sectional shape.

26. A swivel rocker as set forth in claim 23 wherein said seat portion and said back portion define a unitary seat for rocking relative to said support.

27. A swivel rocker chair comprising a base; and a seat frame including a support pivotally mounted on said base, a seat disposed above said support, and means secured to opposite sides of said seat and said support for rocking of said seat relative to said support, each said means having a pair of horizontally spaced ends mounted on said support and being of hollow construction to permit flexing of said ends relative to each other during rocking of said seat relative to said support.

* * * * *

UNITED STATES PATENT AND TRADEMARK OFFICE

CERTIFICATE OF CORRECTION

PATENT NO. : 4,971,394

DATED : Nov. 20, 1990

INVENTOR(S) : ROBERT D. VANDERMINDEN

It is certified that error appears in the above-identified patent and that said Letters Patent is hereby corrected as shown below:

Column 1, line 20 change "construction Further" to
-construction. Further-
Column 1, line 32 change "manner" to -manner.-
Column 2, line 27 change "rocking:" to -rocking;-
Column 3, line 8 change "24A" to -24. A-
Column 5, line 24 change "each of said" to -each said-
Column 6, line 49 change "each of said" to -each said-

Signed and Sealed this

Fourteenth Day of July, 1992

*Attest:*

DOUGLAS B. COMER

*Attesting Officer*

*Acting Commissioner of Patents and Trademarks*